US006564709B2

(12) United States Patent
Sambri

(10) Patent No.: US 6,564,709 B2
(45) Date of Patent: May 20, 2003

(54) DEVICE FOR TRANSMITTING ROTARY MOTION TO A PLATE-HOLDING IMPRESSION CYLINDER OF A PLATE MOUNTING MACHINE FOR FLEXOGRAPHIC PRINTING

(75) Inventor: Stafano Sambri, San Lazzaro di Savena (IT)

(73) Assignee: Bieffebi S.p.A., Quarto Inferiore (IT)

( * ) Notice: Subject to any disclaimer, the term of this patent is extended or adjusted under 35 U.S.C. 154(b) by 0 days.

(21) Appl. No.: 09/956,872

(22) Filed: Sep. 21, 2001

(65) Prior Publication Data

US 2002/0035937 A1 Mar. 28, 2002

(30) Foreign Application Priority Data

Sep. 28, 2000 (IT) ..... BO00A0560

(51) Int. Cl.[7] ..... B41F 5/00; B41F 5/18; B41F 13/24; B41F 13/10; B41F 21/00

(52) U.S. Cl. ..... 101/216; 101/185; 101/247; 101/375; 101/477; 101/621

(58) Field of Search ..... 101/216, 477, 101/DIG. 36, 247, 185, 375; 33/621

(56) References Cited

U.S. PATENT DOCUMENTS 4,128,154 A * 12/1978 Voegelin ..... 192/67
5,215,014 A * 6/1993 Burger et al. ..... 101/248
6,125,752 A * 10/2000 Freddo et al. ..... 101/182

FOREIGN PATENT DOCUMENTS

EP 0 728 580 8/1996

* cited by examiner

*Primary Examiner*—Andrew H. Hirshfeld
*Assistant Examiner*—Marvin Crenshaw
(74) *Attorney, Agent, or Firm*—Guido Modiano; Albert Josif; Daniel J. O'Byrne

(57) ABSTRACT

A device for transmitting rotary motion to a plate-holding impression cylinder of a plate mounting machine for flexographic printing, comprising a backup roll which can be actuated rotatably by a first motor; a beam, which is provided with crescent-shaped rests for rotatably supporting end pivots of the impression cylinder; a gear coaxial to the impression cylinder and rotatably supported by a head associated with the beam; and a hollow transmission shaft engaging at one end, one of the pivots and, at the other end, the gear; the transmission shaft being movable coaxially to the gear between a retracted disengagement configuration and a protruding engagement configuration in which the impression cylinder is actuatable.

11 Claims, 5 Drawing Sheets

1
27
3
23
24
38
37
43
39
36
40
14
16
21
15
11
13
42
35
62
17
33
58
41
8a
34
31
34a
61
7
8
10
30
4
7a 1
28
29
27
26
23
24
25
4
3
30
5
31

DEVICE FOR TRANSMITTING ROTARY MOTION TO A PLATE-HOLDING IMPRESSION CYLINDER OF A PLATE MOUNTING MACHINE FOR FLEXOGRAPHIC PRINTING

BACKGROUND OF THE INVENTION

The present invention relates to a device for transmitting rotary motion to a plate-holding impression cylinder of a plate mounting machine for flexographic printing, suitable to mount the printing plates and to print proofs with the cylinders thus prepared.

Machines such as the one disclosed in U.S. Pat. No. 5,666,881 by the same Applicant are available for mounting printing plates and for printing proofs. These machines have, at the front and in an upward region, a backup roll which is mounted horizontally and so that it can rotate between the sides of the machine, and have, at the front and in a downward region, a horizontal beam which performs a vertical translational motion and has crescent-shaped rests which rotatably support end pivots of an impression cylinder.

The backup roll is covered with a sheet of paper, on which reference markings are provided along generatrices (straight lines) and along directrices (circular lines) of the roller by means of a writing stylus with which said machines are provided for this purpose.

The impression cylinder is covered with an appropriate mounting jacket on which double-adhesive material is used to fix one or more printing plates when the impression cylinder, supported by the beam, is in a mounting position which is spaced from the backup roll.

Optical means are used to precisely position the printing plates on the impression cylinder and are constituted by a semitransparent mirror, which runs along the entire length of the machine, and by video cameras and monitors. Said optical means assist in the alignment of dots and markings provided on the backup roll with dots seen through the mirror on the printing plate.

In printing proofs, the backup roll and the impression cylinder are arranged peripherally adjacent and are actuated so that their peripheral speeds are synchronous. The cylinders can be actuated by means of a gearmotor coupled to a gear system for the kinematic connection of the roller and the cylinder. Said gear system is constituted by a driving gear, which is keyed to the shaft of the gearmotor, and by a first gear, which is coaxial to the axis of the impression cylinder and meshes with a second gear, which is coaxial to the axis of the backup roll.

One problem that is frequently noted in these machines is that depending on the print format to be reproduced on the impression roller it is necessary to change not only the impression cylinder but also the first gear associated with the impression cylinder, since the first gear and the impression cylinder must have the same first pitch circle radius. This entails that for each print format it is necessary to change the corresponding first gear.

Changing the first gear for each print format considerably increases the time required to mount the mounting jacket and accordingly increases the time required to prepare the printing plates in order to then perform the necessary print proofs.

Another problem is linked to the fact that the pitch of the gears conditions the length of the print to be reproduced. The printing length is in fact strictly dependent on the number of pitches, in that the print length can never require a print whose length is equal to a certain number of pitches plus a fraction of a pitch. Furthermore, this entails a waste of material.

Moreover, the presence of gears causes very poor definition of the image to be reproduced, since the gears cause vibrations that are transmitted to the cylinders during printing.

Finally, it is necessary to store and purchase a large number of gears to be adapted to all possible printing formats. This obviously entails corresponding storage problems.

These problems have been partly solved by a type of machine in which the backup roll and the impression cylinder are actuated by respective motor means, which directly actuate the roll and the cylinder so that they have synchronized speeds in their peripheral region. Connection of the respective motor means to the impression cylinder occurs according to the most disparate criteria.

SUMMARY OF THE INVENTION

The aim of the present invention is to obviate the above mentioned drawbacks by providing a device for transmitting rotary motion to an impression cylinder.

Within this aim, an object of the present invention is to provide a connection device in which it is possible to insert/extract the mounting jackets with the aid of devices that support the impression cylinder in a cantilevered fashion and of pneumatic devices that do not occupy considerable space on the machine.

Another object of the present invention is to be able to mount, on the same machine, any kind of impression cylinder, including old-generation cylinders.

Still another object of the present invention is to achieve said aim with a structure which is simple, relatively easy to provide in practice, safe in use, effective in operation, and relatively low in cost.

This aim and this and other objects which will become better apparent hereinafter are achieved by the present device for transmitting rotary motion to a plate-holding impression cylinder of a plate mounting machine for flexographic printing, which is provided at the front, in a horizontally parallel arrangement which allows them to move with respect to each other between a mounting position and a printing position, a backup roll, which can be actuated rotatably by first motor means and is meant to be covered by a sheet of paper provided with reference markings; a beam, which is provided with crescent-shaped rests meant to rotatably support end pivots of said impression cylinder, can be actuated by second motor means and is covered by a jacket for mounting said printing plate; said impression cylinder and said backup roll having synchronized peripheral speeds in said printing position; said device being characterized in that it comprises a gear which is coaxial to said impression cylinder and is rotatably supported by a head associated with said beam, said gear being actuatable by said second motor means, and a hollow transmission shaft which is coaxial to said gear and detachably engages at one end, by way of first coupling elements, one of said pivots and engages, at the other end, by way of second coupling elements, said gear; said transmission shaft, with respect to said mounting position, being movable coaxially to said gear between a retracted disengagement configuration and a protruding configuration for connecting said coupling elements to said impression cylinder and to said gear in order to rotationally couple said impression cylinder to said second motor means.

BRIEF DESCRIPTION OF THE DRAWINGS

Further characteristics and advantages of the present invention will become better apparent hereinafter from the detailed description of a preferred but non-exclusive embodiment of a device for transmitting rotary motion to a plate-holding impression cylinder of a plate mounting machine for flexographic printing, according to the invention, illustrated only by way of non-limitative example in the accompanying drawings, wherein.

DESCRIPTION OF THE PREFERRED EMBODIMENTS

With reference to the figures, the numeral 1 generally designates a machine for mounting printing plates for flexographic printing for performing proof printing and production printing, according to the invention.

Figure 3:
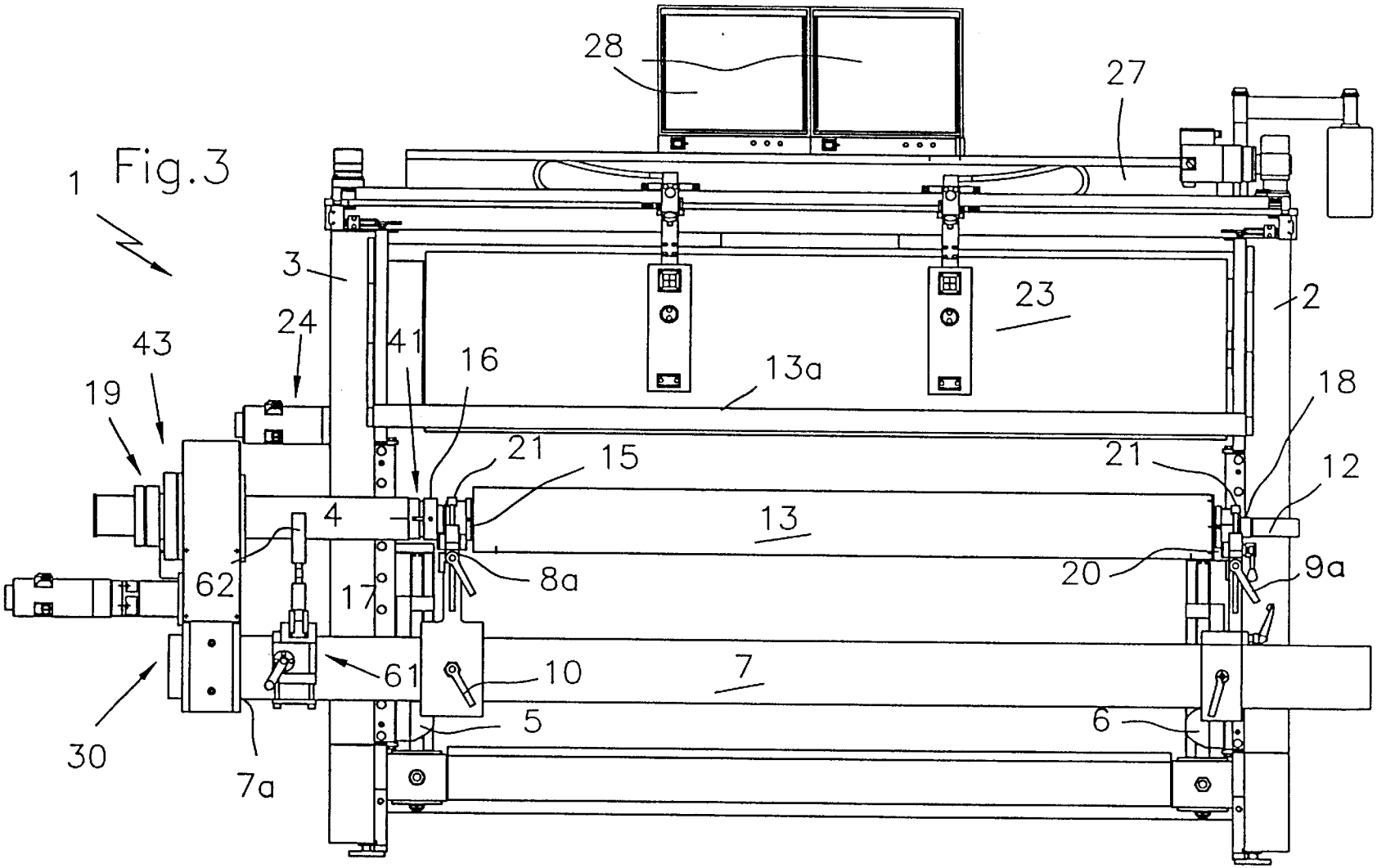
FIG. 3 is a front elevation view of a machine for mounting printing plates for flexographic printing, provided with said device at the side.

The machine 1, as shown in FIG. 3, is constituted by two sides 2 and 3, which act as supports. Parallel to the sides 2 and 3, guides 4 rise vertically for the sliding of two sliders 5 and 6, which support in a monolithic arrangement a horizontal beam 7 that can move vertically between a mounting position and a printing position. The beam 7 adjustably supports two blocks 8 and 9, with which two crescent-shaped rests 8*a*, 9*a* are associated; the rest 9*a* can be turned over on a vertical plane and can be locked in position by means of actuation handles 10. The crescent-shaped rests 8*a*, 9*a* horizontally and rotatably support end pivots 11, 12 of an impression cylinder 13. The pivot 11 is provided with a fixed-diameter sleeve 14, which has an annular element 15 at the end directed toward the impression cylinder 13 and a ring or bush 16 on the other side. The sleeve 14 can be engaged by radial bearings 17, which are rotatably connected to the crescent-shaped rest 8*a*. Likewise, the pivot 12 is provided with a sleeve 18, whose diameter is fixed and equal to the diameter of the sleeve 14 and interacts with other radial bearings 20 rotatably supported by the crescent-shaped rest 9*a*. The radial bearings 17 and 20, in addition to allowing easy rotation of the pivots 11, 12, also prevent their axial movements. Each one of the crescent-shaped rests 8*a*, 9*a* is provided with jaws 21 which are suitable to restrain transverse movements of the impression cylinder 13, so as to allow only the axial rotation of the impression cylinder 13.

The impression cylinder 13 is covered by a mounting jacket 13*a*, onto which the flexographic printing plates are fixed by means of double-adhesive tapes in the mounting position. The impression cylinder 13, in the printing position, is meant to make contact with a horizontal backup roll 23, which is rotatably actuated between the sides 2 and 3 of the machine 1 by first motor means consisting of a motor 24 of the brushless type. The backup roll 23 is covered by a sheet of paper which bears reference markings (lines and dots) provided by means of a writing stylus, not shown in the accompanying drawings; said markings are made to coincide, again in the mounting position, with dots of the printing plate which are seen through optical means.

The optical means, disclosed in greater detail in U.S. Pat. No. 5,666,881 by the same Applicant, are essentially constituted by semitransparent mirrors 25, by television cameras 26 that can be slidingly adjusted along a horizontal cross-member 27, and by monitors 28 arranged on the ceiling 29 of the machine 1. The monitors 28 are suitable to display the markings made on the backup roll 23 and the dots, seen through the semitransparent mirrors 25, of the printing plate mounted on the impression cylinder 13.

A head 30 is anchored at the end 7*a* of the beam 7 and externally supports second motor means 31 and internally rotatably supports a gear 33 kinematically coupled to a driving gear 34 which is coaxial to and rotationally rigidly coupled with respect to the shaft 34*a* of the second motor means 31.

The gear 33 is rotationally rigidly coupled to a bush 35 provided at the opposite ends of respective radial bearings 36 rotatably inserted in seats 37 provided in the head 30. The bush 35 is provided with another gear 38 which is rigidly coupled thereto and is coaxial to the gear 33; a transducer for controlling the angular position of the gear 33 is arranged on said gear 38. The bush 35 is crossed coaxially by a hollow transmission shaft 39, which can move with respect to the bush 35 both axially and rotationally during preparation of the printing position. The transmission shaft 39 detachably engages the pivot 11 at one end 40 by means of first coupling elements 41 and the bush 35 at the other end 42 by means of second coupling elements 43, so as to transmit the rotary motion of the second motor means 31 to the impression cylinder 13.

The first coupling elements 41 are constituted by two recesses 45 formed diametrically opposite on the end 40 and by two conical inserts 46 which protrude in a diametrically opposite manner from the ring or bush 16 in order to engage the two recesses 45.

The second coupling elements 43 consist of a first elastic ring 48, which is rigidly coupled to the transmission shaft 39, and of a second elastic ring 49, which is rotationally rigidly coupled to an elastic flange 50, which is supported coaxially by the bush 35 and can be rotationally connected to the transmission shaft 39 by means of a screw 49*a*. The connection between the elastic flange 50 and the bush 35 is provided by means of screws 51 inserted in the respective through holes of the bush 35 and of the elastic flange 50.

The first and second elastic rings 48, 49 are respectively provided with centering means, constituted by a phase setting slot 53 and by a hole 54 which are substantially parallel to the axis of the impression cylinder 13. The phase setting slot 53 lies on the same plane as the two recesses 45, while the hole 54 lies on the same plane as the two conical inserts 46, so that they are generally mutually staggered. The hole 54 internally retains a reference pin 56, which is meant to enter, with its protruding portion, the phase setting slot 53 when said slot is aligned with the hole 54 or when the phase angle is zero. The alignment between the phase setting slot 53 and the hole 54 is provided by placing the first elastic ring 48 against the second elastic ring 49, moving the transmission shaft 39, at the mounting position, from a retracted disengagement configuration to a protruding connection configuration, at which the phase setting slot 53 is engaged by the reference pin 56 and the two recesses 45 are engaged by the two conical inserts 46, thus providing, by tightening the screw 49*a*, the rotary connection between the second motor means 31 and the impression cylinder 13.

The transmission shaft 39 internally accommodates a compressed air supply hose 57, which has a gravity joint 58 at its end. The gravity joint 58, when the transmission shaft 39 is in a retracted uncoupling position, is inserted in a channel 60, which is internal and coaxial to the pivot 11. The channel 60 feeds compressed air into the printing cylinder 13, from which it escapes through appropriate holes 63 formed radially in the impression cylinder 13 in order to allow easy insertion/extraction of the printing plate mounting jacket 13*a* when the impression cylinder is in the mounting position.

Finally, the beam 7 between the head 30 and the block 8 adjustably supports a jack 61 provided, at its end, with a hook 62 which engages, at the mounting position, the tip of the pivot 11 so that it can support in a cantilevered manner the impression cylinder 13 when the crescent-shaped rest 9*a* is turned over, thus allowing the rapid insertion/extraction of the mounting jacket on the side of the pivot 12.

Figure 1:
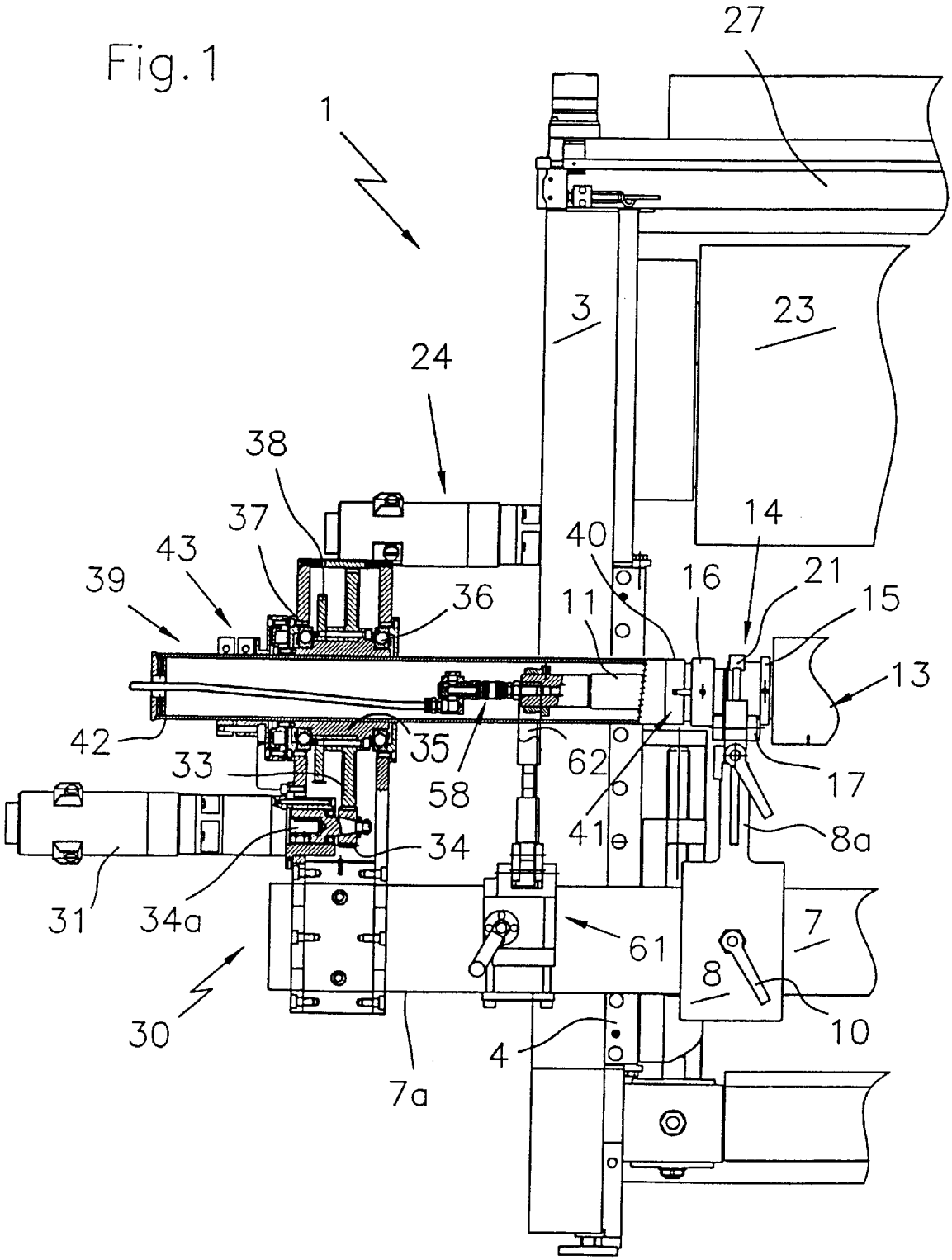
FIG. 1 is a partially sectional front elevation view of said device, mounted on a plate mounting machine for flexographic printing, according to the invention.
Figure 2:
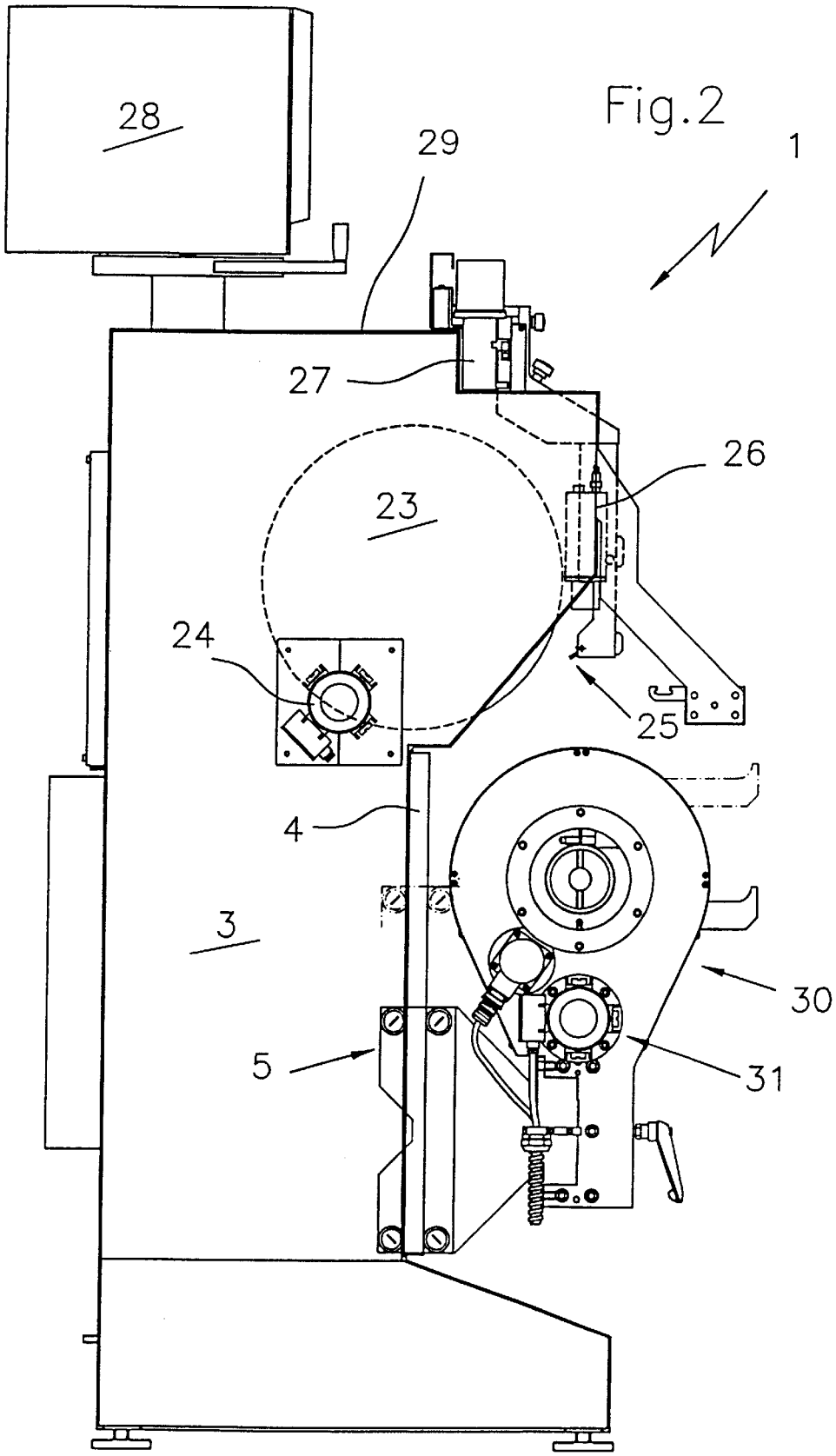
FIG. 2 is a side elevation view of the head of said device.
Figure 4:
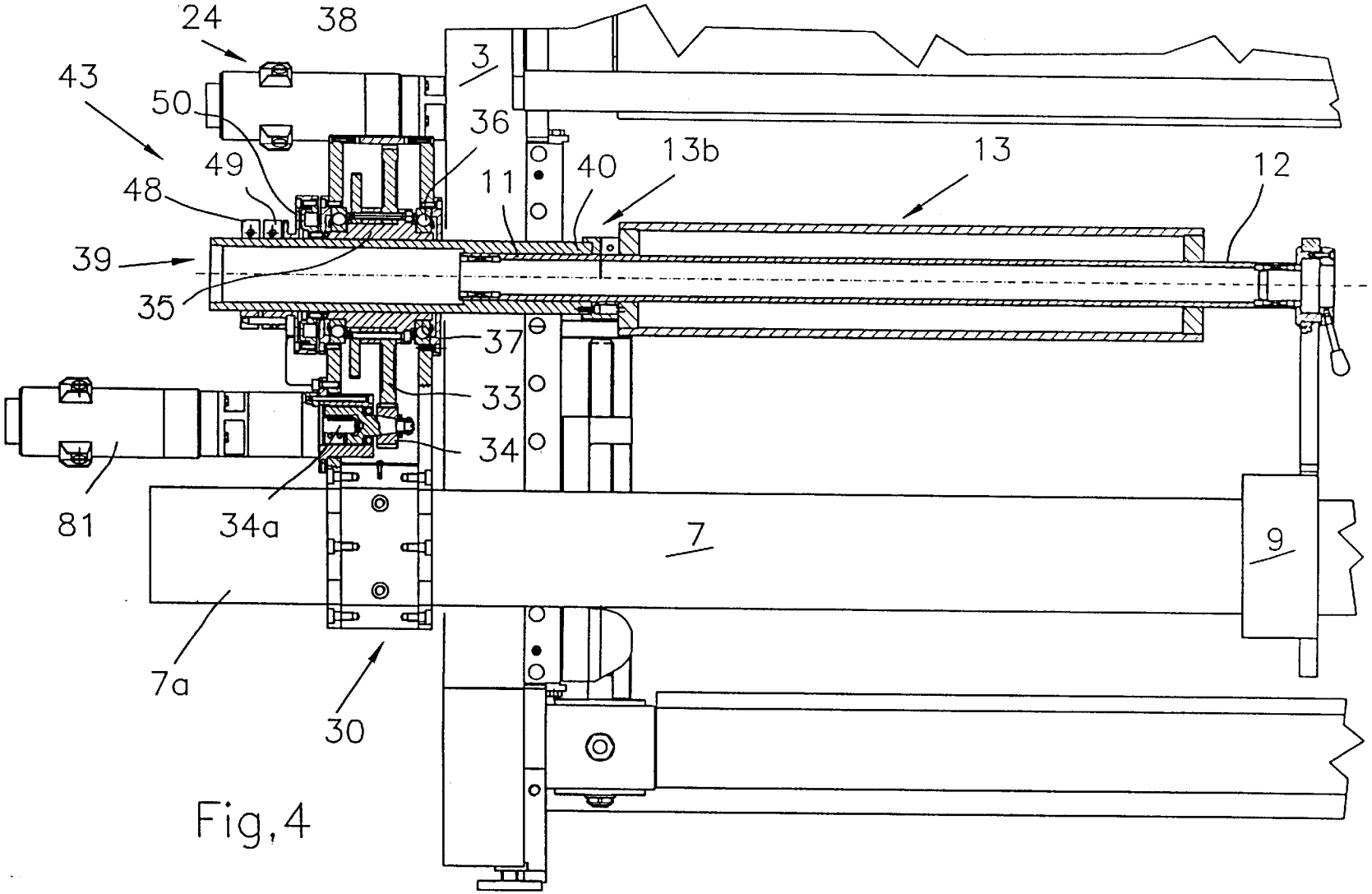
FIG. 4 is an enlarged-scale partially sectional front elevation view of said device associated with a small impression cylinder.
Figure 5:
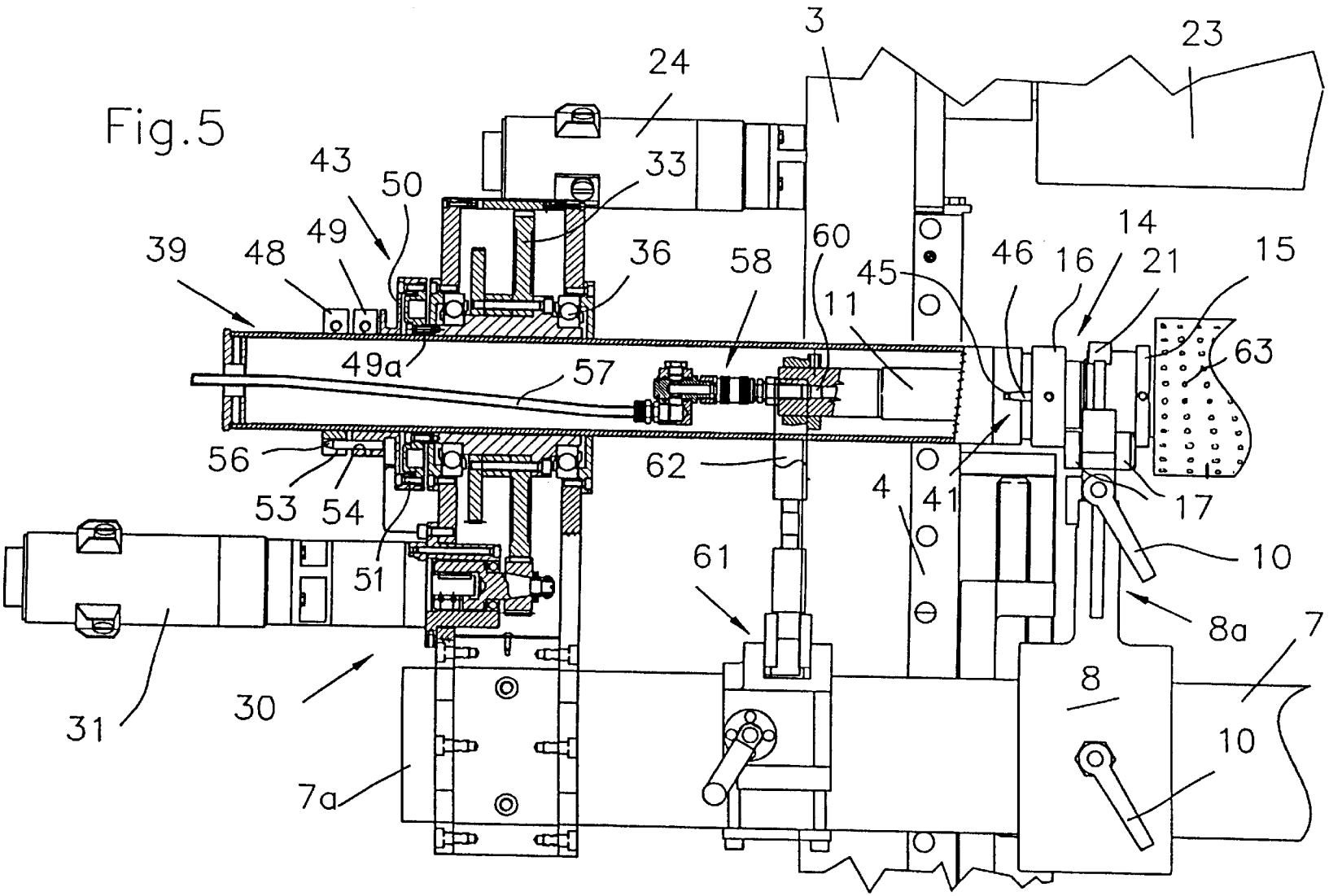
FIG. 5 is an enlarged-scale view of said device according to the invention.

In practical operation, starting from the mounting position, in which the beam 7 is lowered as shown in FIGS. 1, 3 and 4, the impression cylinder 13 rests rotatably, by means of the pivots 11 and 12, on the bearings 17 and 20, which prevent its axial sliding, while transverse sliding is restrained by the jaws 21, which completely fix the pivots 11 and 12 on the crescent-shaped rests 8*a*, 9*a*. At this point, the following operations are performed in order to fit the mounting jacket 13*a* on the peripheral region of the impression cylinder 13. First, by using the jack 61 and its hook 62, the tip of the pivot 11 is fixed; then the arm of the jack 61 is actuated vertically downward by an extent which allows the crescent-shaped rest 9*a* to overturn. In this situation, the impression cylinder 13 is supported in a cantilevered manner by the jack 61 by means of the fulcrum obtained by means of the crescent-shaped rest 8*a*. In this context it is possible to insert/extract the mounting jacket 13*a* from the side of the pivot 12. This operation is performed easily by means of the compressed air introduced from the gravity joint 58. The compressed air flows out of the inside of the impression cylinder 13 through radial holes, and by slightly inflating the mounting jacket 13*a* it thus allows the insertion/extraction of the mounting jacket. Once this operation has been completed, the crescent-shaped rest 9*a* is returned to the initial position and the jack 61 is disabled, so that the impression cylinder 13 is rotatably rigidly coupled on the crescent-shaped rests 8*a* and 9*a*.

The rotary connection of the impression cylinder 13 to the second motor means 31 is achieved by producing an axial translational motion of the transmission shaft 39, which in the transition from the retracted disengagement configuration to the protruding coupling configuration places the first elastic ring 48 adjacent to the second elastic ring 49. By aligning the phase setting slot 53 with the hole 54 by means of the insertion of the reference pin 56, the correct angular phase is achieved for inserting the conical inserts 46 in the recesses 45, thus providing the rotary connection between the transmission shaft 39 and the impression cylinder 13. The rotary connection of the transmission shaft 39 to the bush 35 or to the second motor means 31 is achieved by tightening the screw 49*a* of the second elastic ring 49. At this point, the rotary connection between the second motor means 31 and the impression cylinder 13 is achieved fully.

After rotationally connecting the second motor means 31 to the impression cylinder 13, the printing plate is positioned on the mounting jacket 15 and its dots are made to coincide, with the aid of the optical means, with the markings provided on the paper sheet that covers the backup roll 23. After this step, the impression cylinder 13 moves from the mounting position to the printing position, at which it is arranged peripherally adjacent to the backup roll 23. In the printing position, the cylinder 13 and roll 23 are actuated by the first and second motor means so that their peripheral speeds are synchronous in order to be able to perform printing proofs. Conveniently, the motor means are controlled with a logic system known as PLC so that the cylinders have the same peripheral speed.

In order to produce prints in a different format, it is sufficient to remove the preceding impression cylinder 13, replacing it with another one having a different pitch circle radius and performing the previously described operations for said cylinder.

It has thus been shown that the invention achieves the proposed aim and objects.

In particular, the fact is stressed that when the print format changes, the mounting times are reduced considerably, since it is not necessary to remove mechanical components required for the transmission of rotary motion to the impression cylinder. It is in fact noted that the rotary connection between the impression cylinder and the motor means for actuating the cylinder is extremely simple and fast.

Furthermore, said device is highly flexible in its applications, since it can be easily adapted also to old-generation impression cylinders. It is in fact possible to provide the pivots of old impression cylinders with the same sleeves applied to the above considered impression cylinders.

The invention thus conceived is susceptible of numerous modifications and variations, all of which are within the scope of the inventive concept.

Advantageously, impression cylinders 13, particularly small ones, are provided in which the pivot 11 can be rotationally coupled in a bayonet-like fashion to the cavity of the transmission shaft 39 and the pivot 12 rests rotatably on the crescent-shaped rest 9*a*. The rotary connection can be obtained by means of an elastic ring 13*b*, which is rigidly coupled to the pivot 11 and can be fastened to the end 40 of the transmission shaft 39. In this manner, by turning over the crescent-shaped rest 9*a* it is possible to support in a cantilevered fashion, by means of the head 30 and the transmission shaft 39, the impression cylinder 13 and allow the rapid insertion-extraction of the mounting jacket 13*a* along the peripheral region of the impression cylinder 13.

All the details may further be replaced with other technically equivalent ones.

In practice, the materials used, as well as the shapes and dimensions, may be any according to the requirements without thereby abandoning the scope of the protection of the appended claims.

The disclosures in Italian Patent Application No. BO2000A000560 from which this application claims priority are incorporated herein by reference.

What is claimed is:

1. A device for transmitting rotary motion to a plate-holding impression cylinder of a plate mounting machine for flexographic printing, comprising: first motor means; a backup roll which is actuated in rotation by said first motor means, said backup roll being adapted to be covered by a sheet of paper provided with reference markings; a beam, having a head associated therewith; crescent-shaped rests arranged at said beam rests to rotatably support end pivots of said impression cylinder; second motor means for actuating said impression cylinder; a jacket covering said impression cylinder for mounting said printing plate; said beam and backup roll being provided at the front of the machine in a horizontally parallel arrangement which allows movement thereof with respect to each other between a mounting position and a printing position, and said impression cylinder and said backup roll having synchronized peripheral speeds in said printing position; a gear which is coaxial to said impression cylinder and is rotatably supported by said head associated with said beam, said gear being actuatable by said second motor means; first and second coupling elements; and a hollow transmission shaft which is coaxial to said gear and detachably engages at a first end, through said first coupling elements, one of said end pivots and engages at a second end, through said second coupling elements, said gear, said transmission shaft, with reference to said mounting position, being movable coaxially to said gear between a retracted disengagement configuration and a protruding configuration for connecting said first and second coupling elements to said impression cylinder and to said gear in order to rotationally couple said impression cylinder to said second motor means.

2. The device of claim 1, wherein said first coupling elements are constituted by two recesses which are formed diametrically opposite to each other at the end of said transmission shaft by a ring fitted on said one of said pivots which is directed toward said head, and by two conical inserts which protrude from said ring.

3. The device of claim 2, further comprising radial bearings which are inserted rotatably in respective seats of said head; and a bush provided at the ends of said bearings, said gear being coaxially rigidly coupled to said bush.

4. The device of claim 2, further comprising: a channel which is coaxial to one of said pivots, which is directed towards said head; a compressed air hose accomodated internally to said transmission shaft; a rotary gravity joint insertable, in relation to said retracted disengagement configuration, into said channel, and wherein said impression cylinder is provided with radial holes, said rotary gravity joint being connected to said hose and being suitable to introduce through said channel compressed air into said impression cylinder and radial holes formed in said impression cylinder, in order to allow easy insertion/extraction of the printing plate mounting jacket.

5. The device of claim 3, wherein said second coupling elements are constituted by a first elastic ring, which is rotationally rigidly coupled to said transmission shaft, by an elastic flange connected to said bush, and by a second elastic ring, which is rotationally rigidly coupled to said elastic flange.

6. The device of claim 5, wherein said second elastic ring is provided with a screw for rotationally connecting said second elastic ring to said transmission shaft.

7. The device of claim 6, wherein said first and second elastic rings have centering means for allowing angular alignment between said two recesses and said conical inserts.

8. The device of claim 7, wherein said centering means are constituted by a phase setting slot and by a hole, which are provided in said first and second rings and are substantially parallel to an axis of said impression cylinder, so that upon alignment of said slot and hole, during transition from the retracted disengagement configuration to the protruding connection configuration, alignment between said pair of recesses and said conical inserts is obtained.

9. The device of claim 8, further comprising a reference pin, said hole retaining internally and coaxially a portion of said reference pin.

10. The device of claim 9, wherein said hole and slot are crossed by said reference pin, when aligned at said protruding connection configuration, whereby to rotationally lock said transmission shaft to said gear.

11. The device of claim 10, further comprising: a further elastic ring which is coaxially rigidly coupled to one of said end pivots, directed towards said head, which is rotationally coupled, in a bayonet-like fashion, to said transmission shaft through said further elastic ring, the other end pivot being rotatably supported by the respective crescent-shaped rest so that when it is lowered in said mounting position said transmission shaft supports said impression cylinder in a cantilevered fashion.

* * * * *